US007987687B2

(12) United States Patent
Spycher et al.

(10) Patent No.: US 7,987,687 B2
(45) Date of Patent: Aug. 2, 2011

(54) ELECTROMECHANICAL ROTARY LOCK CYLINDER

(75) Inventors: Martin Spycher, Richterswil (CH); Urs Oechslin, Maur (CH); Bruno Vonlanthen, Schanis (CH); Marcel Kolliker, Kusnacht (CH); Dieter Peier, Biberist (CH)

(73) Assignee: Keso AG, Richterswill (CH)

( * ) Notice: Subject to any disclaimer, the term of this patent is extended or adjusted under 35 U.S.C. 154(b) by 429 days.

(21) Appl. No.: 12/159,612

(22) PCT Filed: Dec. 13, 2006

(86) PCT No.: PCT/CH2006/000695

§ 371 (c)(1),
(2), (4) Date: Jun. 27, 2008

(87) PCT Pub. No.: WO2007/073608

PCT Pub. Date: Jul. 5, 2007

(65) Prior Publication Data

US 2009/0007613 A1 Jan. 8, 2009

(30) Foreign Application Priority Data

Dec. 27, 2005 (CH) ..... 2078/05

(51) Int. Cl.
*E05B 49/00* (2006.01)

(52) U.S. Cl. ..... 70/278.7; 70/278.3; 70/283.1

(58) Field of Classification Search ..... 70/278.1–278.3, 70/278.7, 283, 283.1, 277
See application file for complete search history.

(56) References Cited

U.S. PATENT DOCUMENTS

| | | | | |
|---|---|---|---|---|
| 4,798,068 | A * | 1/1989 | Nakauchi | 70/276 |
| 4,848,115 | A * | 7/1989 | Clarkson et al. | 70/276 |
| 4,916,927 | A * | 4/1990 | O'Connell et al. | 70/276 |
| 4,939,915 | A | 7/1990 | Vonlanthen | |
| 5,507,162 | A * | 4/1996 | Chhatwal | 70/278.3 |
| 5,542,274 | A * | 8/1996 | Thordmark et al. | 70/495 |
| 5,552,777 | A * | 9/1996 | Gokcebay et al. | 340/5.54 |
| 5,628,217 | A | 5/1997 | Herrera | |
| 5,826,450 | A | 10/1998 | Lerchner et al. | |
| 5,839,305 | A * | 11/1998 | Aston | 70/283.1 |
| 5,839,307 | A * | 11/1998 | Field et al. | 70/283 |
| 6,000,609 | A * | 12/1999 | Gokcebay et al. | 235/382 |
| 6,227,020 | B1 * | 5/2001 | Lerchner | 70/278.3 |
| 6,370,928 | B1 * | 4/2002 | Chies et al. | 70/278.3 |
| 6,374,653 | B1 * | 4/2002 | Gokcebay et al. | 70/278.3 |

(Continued)

FOREIGN PATENT DOCUMENTS

DE 4324711 A1 1/1995

(Continued)

*Primary Examiner* — Suzanne D Barrett
(74) *Attorney, Agent, or Firm* — Browdy and Neimark, PLLC

(57) ABSTRACT

Disclosed is a rotary lock cylinder comprising a blocking element (25, 64) that engages into the rotor (10) in a closed position while releasing the rotor (10) in an open position. An actuator (17, 78) can be controlled in accordance with data located on the key (2). In order to displace the blocking element (25, 64) from the closed position into the open position, a latch element (33, 63) is provided which can be moved along with the key (2). The blocking element (25, 64) can be attached by means of the actuator (17). The energy required for moving the blocking element (25) is supplied by the user when introducing the key (2) into the key duct (11) such that the load on the power source used for actuating the actuator (17, 78) is minimal.

15 Claims, 8 Drawing Sheets

U.S. PATENT DOCUMENTS

Figure 1:
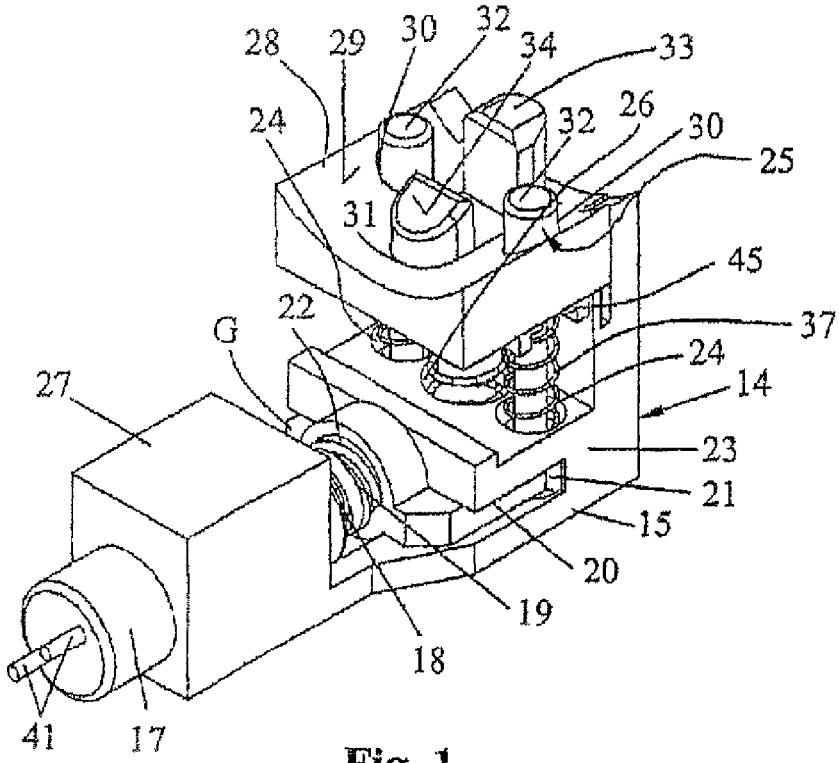

| | | | | |
|---|---|---|---|---|
| 6,412,321 | B1 * | 7/2002 | Aramburu et al. | 70/278.3 |
| 6,442,986 | B1 * | 9/2002 | Russell et al. | 70/278.3 |
| 6,523,377 | B1 * | 2/2003 | Vonlanthen | 70/278.3 |
| 6,564,601 | B2 * | 5/2003 | Hyatt, Jr. | 70/278.3 |
| 6,668,606 | B1 * | 12/2003 | Russell et al. | 70/278.3 |
| 6,826,935 | B2 * | 12/2004 | Gokcebay et al. | 70/278.3 |
| 6,840,072 | B2 * | 1/2005 | Russell et al. | 70/278.3 |
| 6,865,916 | B2 * | 3/2005 | Goldman | 70/472 |
| 6,895,792 | B2 * | 5/2005 | Davis | 70/278.3 |
| 7,316,140 | B2 * | 1/2008 | Russell et al. | 70/278.3 |
| 7,690,231 | B1 * | 4/2010 | Field et al. | 70/283 |
| 2002/0189307 | A1 * | 12/2002 | Gokcebay et al. | 70/278.3 |
| 2005/0144995 | A1 | 7/2005 | Russell | |
| 2006/0138789 | A1 | 6/2006 | Luling et al. | |
| 2006/0156771 | A1 | 7/2006 | Hauri | |
| 2006/0230796 | A1 | 10/2006 | Keller et al. | |
| 2008/0141743 | A1 * | 6/2008 | Andersson | 70/283 |

FOREIGN PATENT DOCUMENTS

| | | | |
|---|---|---|---|
| DE | 19517704 | A1 | 11/1996 |
| DE | 19517728 | C2 | 11/1996 |
| DE | 10115074 | A1 | 10/2002 |
| DE | 10359620 | A1 | 7/2004 |
| EP | 0278906 | A1 | 8/1988 |
| EP | 0712981 | B1 | 5/1996 |
| WO | 03078766 | A1 | 9/2003 |
| WO | 2004057137 | A1 | 7/2004 |
| WO | 2004066220 | A1 | 8/2004 |

* cited by examiner

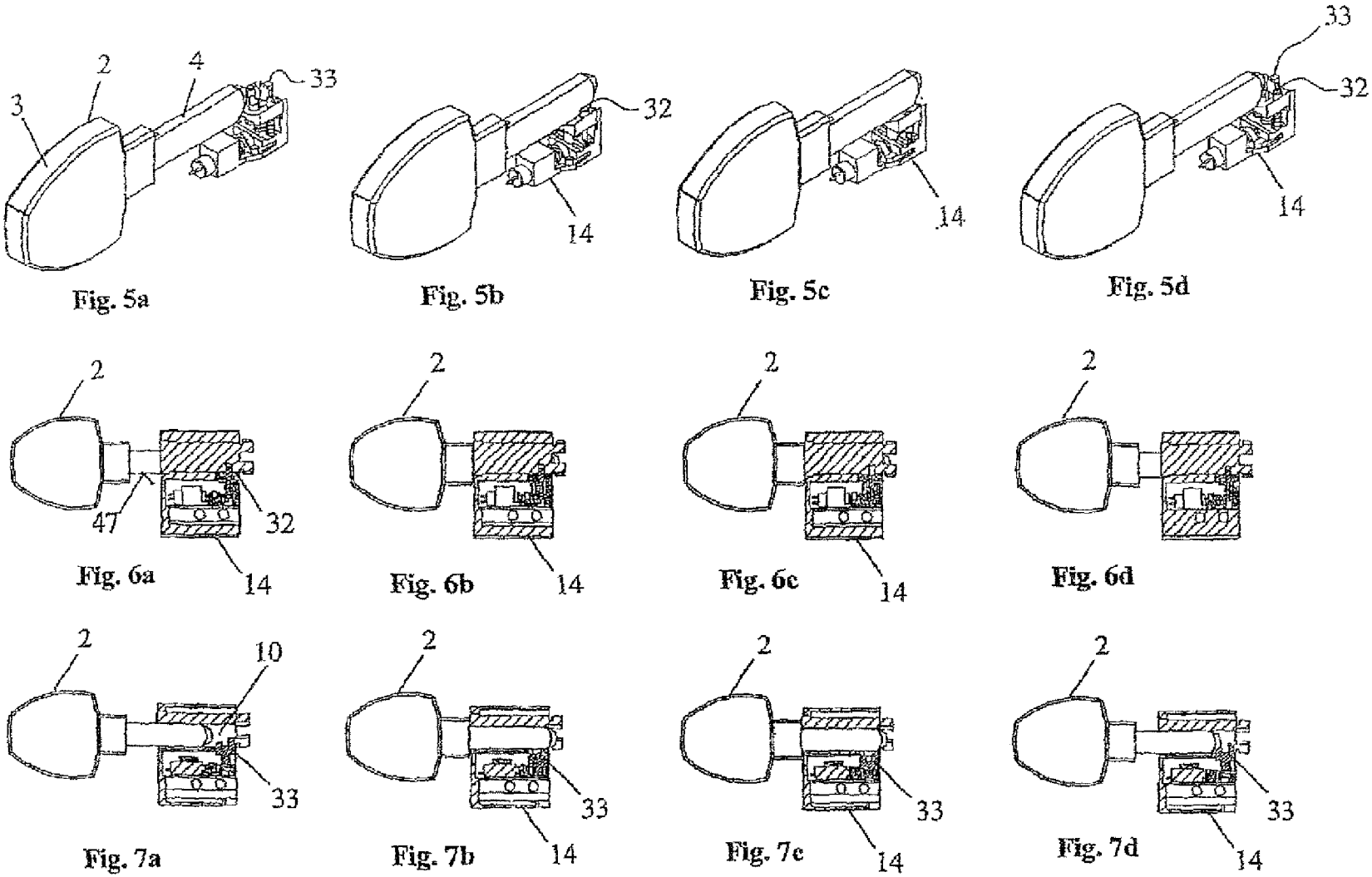
33
32
14
14
32
14
33
4
2
3
2
2
2

2
4
1'
10
60

2
60
78

63
64
60
72
71
64

64
88
64
68

69
74
71
73
66

64
64
71
77
68

ELECTROMECHANICAL ROTARY LOCK CYLINDER

The invention relates to an electromechanical rotary lock cylinder having a stator and a rotor mounted therein, having a blocking element which is mounted in a bottom part of the stator and, in a locked position, engages in the rotor and, in an open position, releases the rotor, and having an actuator which can be controlled in dependence on information arranged on a key.

Electromechanical lock cylinders of the type mentioned have been known for some time now. They have the advantage of making possible an increased level of security by way of electronically secured user recognition. As a result of this user recognition, it is only once predetermined electronic information has been entered that the rotor can be actuated by the key which has been introduced.

An electromechanical rotary lock cylinder has been disclosed, for example, by EP 0 712 181 A (AZBE). This cylinder has, as blocking element, a blocking pin which is mounted in a cylinder pocket and is connected to an electric motor via an eccentric. By virtue of the shaft of the electric motor being rotated, the pin can be displaced from a first position into a second position when the electronic code read from a key inserted into the lock cylinder corresponds to a code stored in a store of the lock cylinder. In order to supply power to the electric motor, batteries are mounted in the cylinder pocket. In the case of this rotary lock cylinder, the energy consumption for displacing the blocking element and/or the blocking pin is comparatively high. It is therefore necessary for the batteries to be exchanged comparatively frequently.

DE 195 17 728 C (Keso GmbH) likewise discloses an electromechanical rotary lock cylinder of the type mentioned. In the case of this cylinder, the blocking element is designed as a clip which engages in recesses of the rotor. The cylinder pocket contains an actuator which has an electric motor, of which the shaft is provided with two protuberances which are located opposite one another and, in the blocking position, act on the clip. Once the clip has been released, then it can be forced out of the recesses in the circumferential surface of the cylinder core by manual force as the key plugged into the cylinder core is rotated. Incorrect operation may result in the two protuberances becoming jammed between the clip and the cylinder housing, which may lead to increased energy consumption.

DE 195 17 704 A (BKS) discloses an electromechanical rotary lock cylinder in the case of which the blocking element is likewise designed as a displaceable pin. This pin is likewise coupled to an electric motor via an eccentric. When the eccentric is rotated, the blocking pin is displaced. Here too, the energy consumption for actuating the block element is comparatively high.

The object of the invention is to provide an electromechanical rotary lock cylinder of the type mentioned which is distinguished by considerably lower energy consumption and which is nevertheless cost-effective to produce and functionally reliable.

The object is achieved, in the case of a rotary lock cylinder of the generic type according to claim 1, in that a latch element, which can be actuated by the key, is provided in order to displace the blocking element from the locked position into the open position, and in that the blocking element is fixed in the locked position and is released by virtue of the actuator being actuated. In the case of the rotary lock cylinder according to the invention, the blocking element is moved by a latch element rather than by the actuator. The energy for this purpose is applied mechanically as the key shank is pushed into the key channel. The energy for displacing the blocking element is thus applied mechanically by the user by introducing the key into the key channel. The actuator serves merely for fixing the blocking element in the locked position.

According to a development of the invention, it is provided that the latch element projects into the key channel in a rear region of the rotor and can be moved by the key introduced into the key channel. When the key is introduced into the key channel, the latch element is moved for example downward into the motor just before the key shank is introduced to the full extent. This allows very straightforward and reliable actuation of the latch element.

According to a development of the invention, it is provided that a movable part, which can be moved between two positions by the actuator, is provided in order to fix the blocking element, the blocking element being blocked in a first position and being released in a second position. Such a movement can take place with very low outlay in terms of energy. The movable part is preferably designed as a slide, on which the blocking element rests in the blocked position.

According to a development of the invention, it is provided that the movable part has a surface which is inclined in relation to the movement direction of the blocking element and against which the blocking element rests in the blocked position. This inclined surface makes it possible for the slide to be moved away from the blocking element with only a very small amount of friction. The slide preferably rests against the bottom end of the blocking element by way of the inclined surface. The blocking element preferably has two blocking pins, which each engage in the rotor by way of one end.

According to a development of the invention, it is provided that the blocking element can be biased by at least one spring element, or some other energy-storage element, by virtue of the latch element being actuated. If the blocking element is released by virtue of the actuator being actuated, then, on account of the biasing of the spring element, the blocking element moves immediately into the open position, in which the rotor can be rotated. It is preferably likewise the case that the latch element, as it is actuated, is likewise biased by a spring element, or by some other suitable energy-storage element, in which case the latch element moves automatically into the starting position again when the key is withdrawn. The blocking element here is likewise guided automatically by the latch element into the starting position, and thus into the locked position.

According to a development of the invention, the blocking element is formed by two blocking pins which are operatively connected to the latch element.

According to a development of the invention, the latch element has a contact element which allows further mechatronic functions, in particular programming of the electronics unit with a programming key and/or supply to the control arrangement.

Further advantageous features can be gathered from the dependent claims, from the following description and from the drawing.

Figure 2:
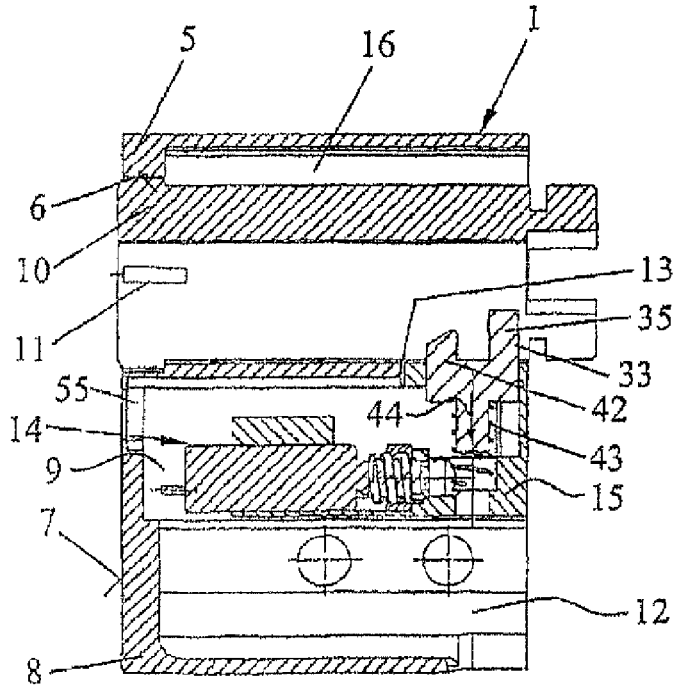
Figure 3:
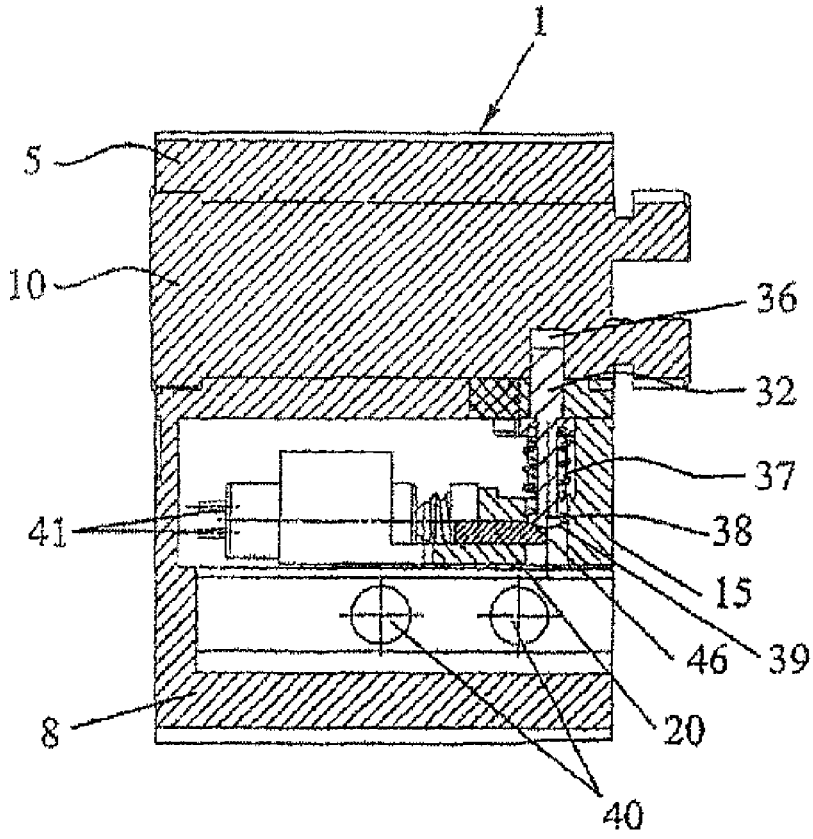
Figure 4:
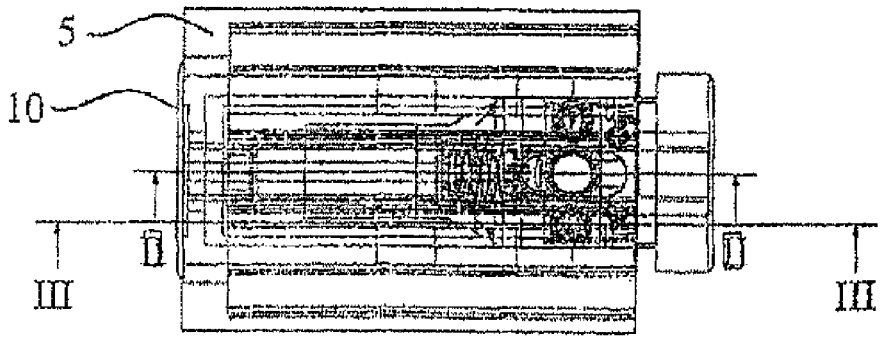
Figure 8:
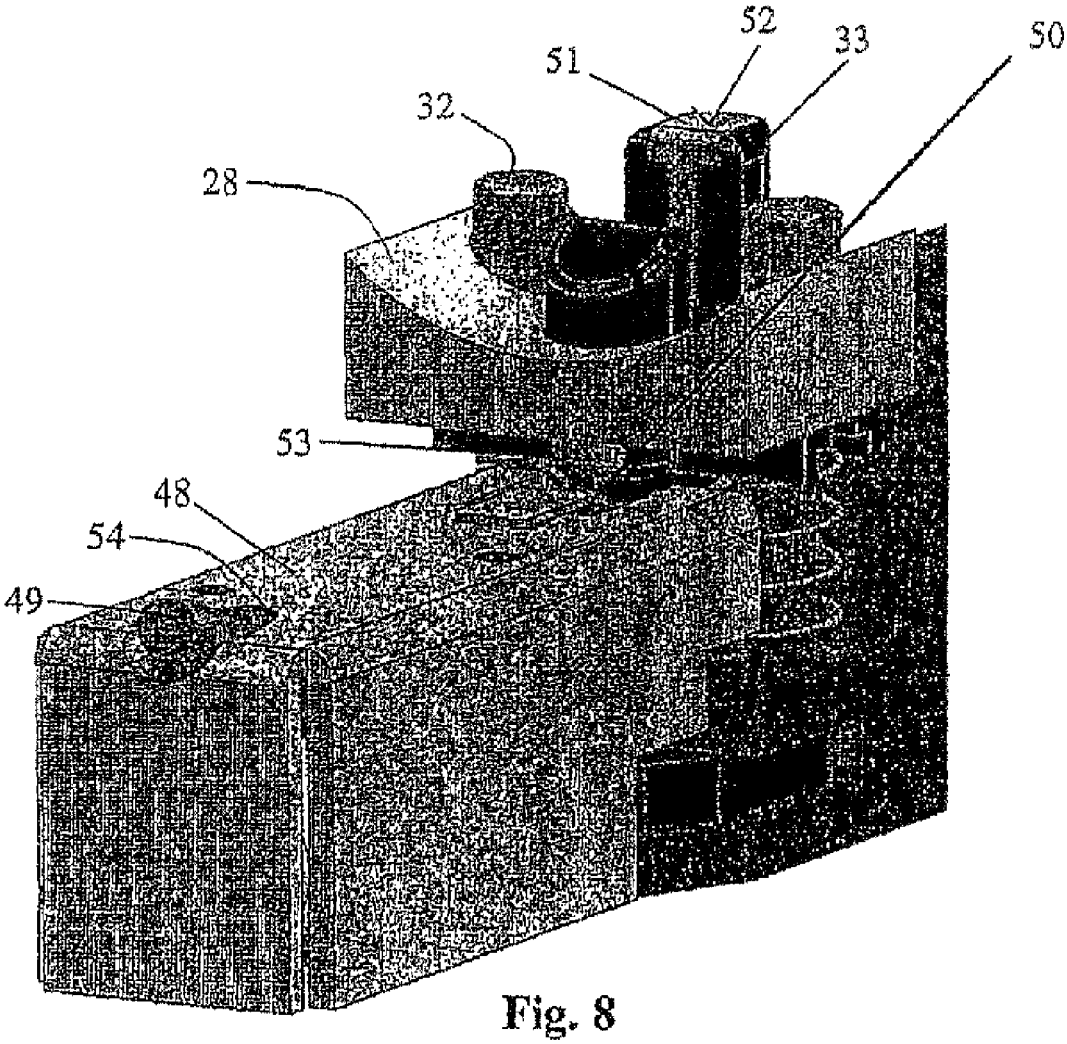
Figure 9:
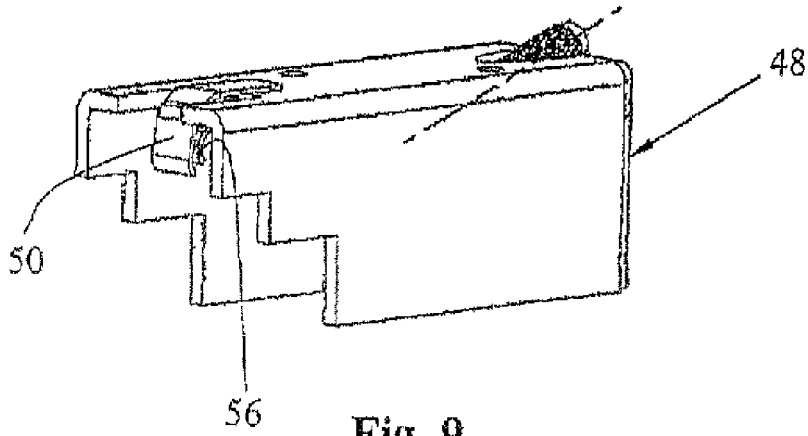
Figure 10:
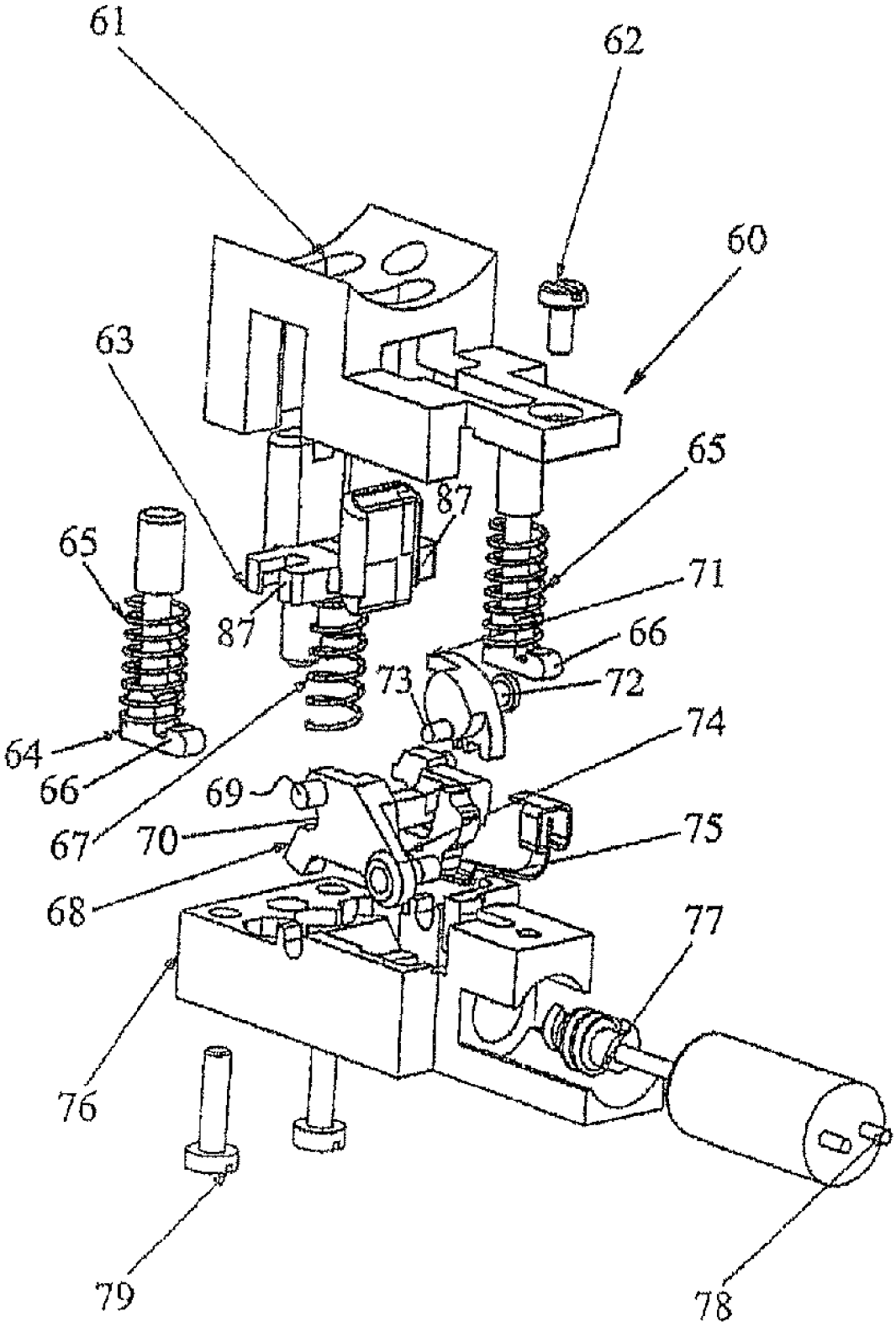
Figure 11:
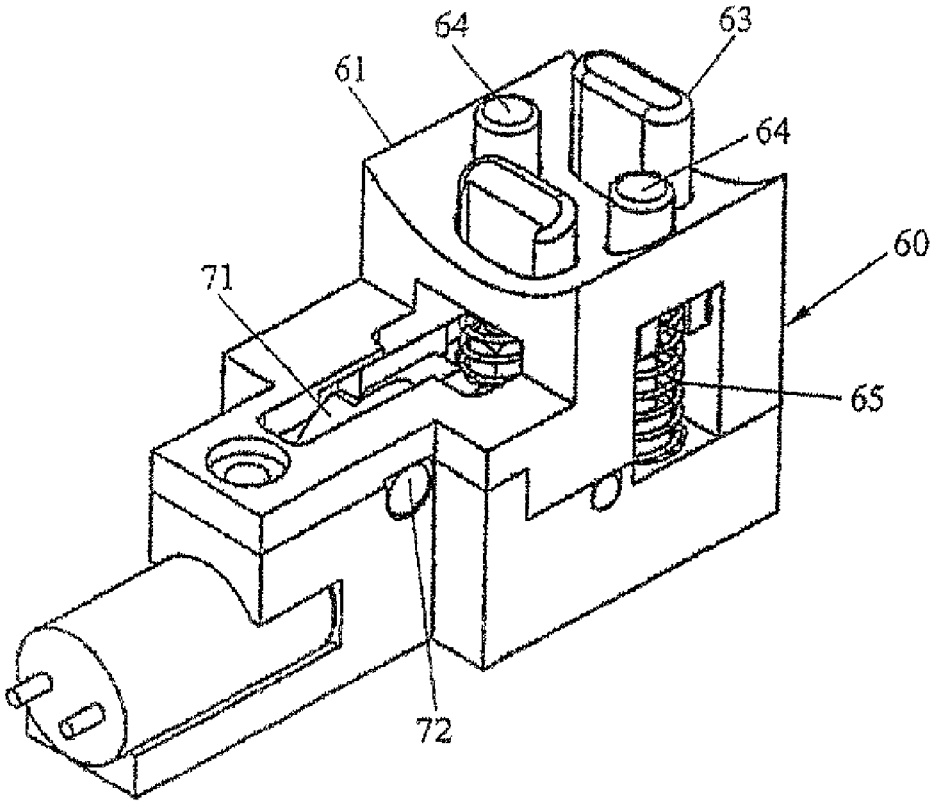
Figure 12:
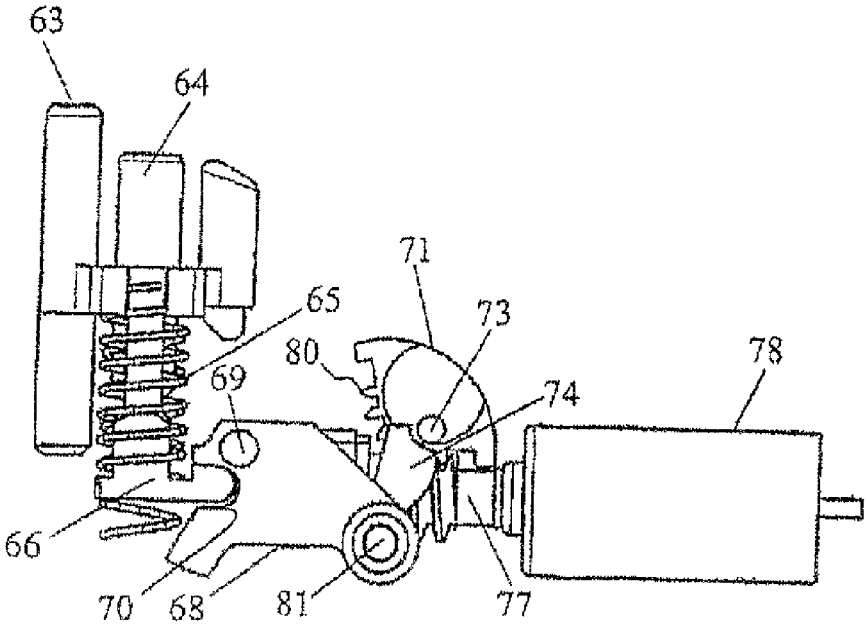
Figure 13:
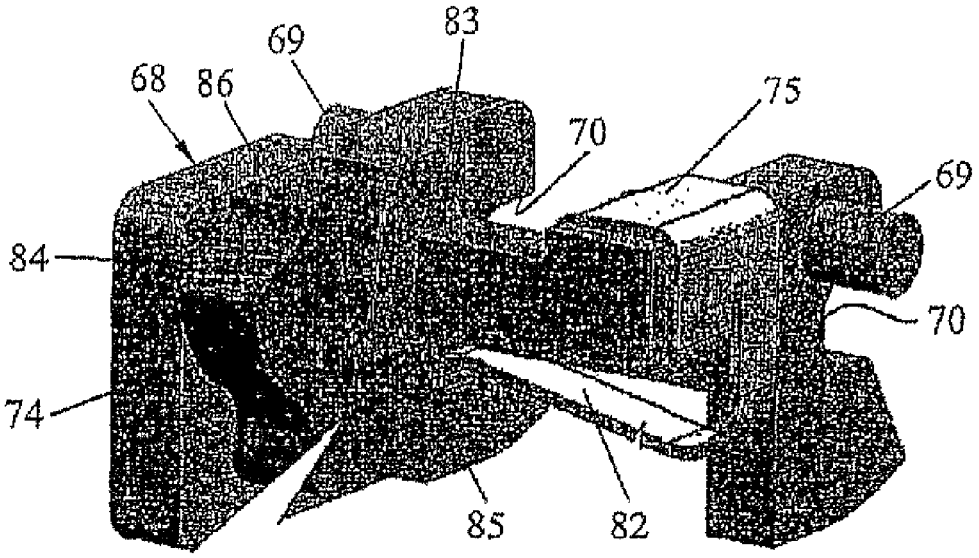
Figure 14:
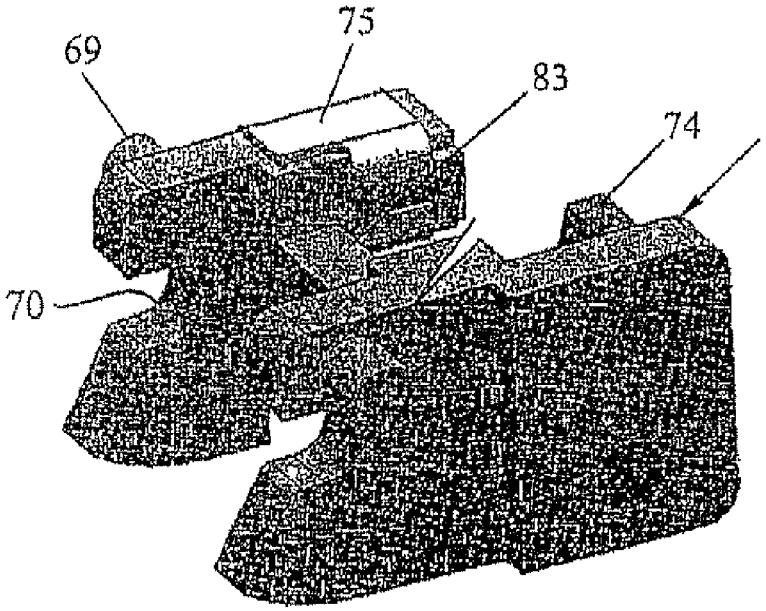

An exemplary embodiment of the invention will be explained in more detail hereinbelow with reference to the drawing, in which:

FIG. 1 shows a three-dimensional view of part of the rotary lock cylinder according to the invention, this part having the actuator, the blocking element and the latch element, FIG. 2 shows a section through the rotary lock cylinder according to the invention along line II-II from FIG. 4, FIG. 3 shows a section through the rotary lock cylinder according to the invention along line III-III from FIG. 4, FIG. 4 shows a plan view of the rotary lock cylinder according to the invention, concealed edges being depicted by dashed lines, FIGS. 5*a* to 5*d* show a three-dimensional view of the key in different positions in relation to the part which is shown in FIG. 1, FIGS. 6*a* to 6*d* show views according to FIGS. 5*a* to 5*d*, the rotary lock cylinder being shown in section according to FIG. 3, FIGS. 7*a* to 7*d* show illustrations according to FIGS. 5*a* to 5*d*, the rotary lock cylinder being shown in section according to FIG. 2, FIG. 8 shows a further three-dimensional view of the part according to FIG. 1, and FIG. 9 shows, schematically, a three-dimensional view of the control arrangement, FIG. 10 shows an exploded drawing of a variant of an actuating arrangement, FIG. 11 shows a three-dimensional view of the actuating arrangement according to claim 10, FIG. 12 shows a view of the actuating arrangement according to FIG. 10, the housing having been left out, FIG. 13 shows a three-dimensional view of part of the actuating arrangement according to FIG. 10, FIG. 14 shows a further three-dimensional view of the part according to FIG. 13, FIGS. 15*a*, 16*a*, 17*a* and 18*a* show sections through a rotary-lock-cylinder half with a key at different plug-in depths, FIGS. 15*b*, 16*b*, 17*b* and 18*b* show three-dimensional views of the actuating arrangement with a key in different positions, and FIGS. 15*c*, 16*c*, 17*c* and 18*c* show three-dimensional views of the variant of the actuating arrangement in different positions.

The rotary lock cylinder 1, which is shown in FIGS. 2 to 4, has a rotor 10 which is mounted in a bore 6 of a stator 5. The rotor 10 has a key channel 11 into which a shank 4 of a key 2 can be introduced according to FIGS. 7*a* to 7*d*. Tumblers (not shown here) are appropriately positioned by way of bores (not shown here) in the key shank 4. These tumblers have core pins and housing pins, which are mounted in slides (not shown here) arranged in recesses 16 (FIG. 2) of the stator 5. Coupled to the rotor 10 is a driver (not shown here) which can actuate a bolt of a lock (not shown here). The rotary lock cylinder 1 may be a single rotary lock cylinder with just one rotor 10 or a double rotary lock cylinder with two rotors 10 and, correspondingly, two stators 5.

The key 2 may be designed in accordance with the applicant's WO 2004/066220. The key 2 may thus contain, in a known manner, a control circuit and a transmitting and receiving circuit, in which case information signals can be transmitted to the control circuit of the rotary lock cylinder 1. The rotary lock cylinder 1 here can be operated on a "stand alone" or networked basis.

The stator 5 has a cylinder pocket 8 with a recess 12 which is open on the rear side and is intended for receiving a connecting crosspiece (not shown here). The cylinder pocket, according to FIG. 3, contains bores 40 which receive pins (not shown here) which connect the abovementioned connecting crosspiece to the stator 5.

The recess 12 is connected to a further recess 9, which is arranged at the top and into which the actuating arrangement 14, which is shown in FIG. 1, is inserted. This actuating arrangement serves for actuating a blocking element 25, which has two spaced-apart blocking pins 32 each mounted in a displaceable manner in a bore 30 of a guide element 28. The guide element 28, which is of plate-like design, is fastened on a carrier 15. This carrier 15 has a block 27 in which an electric motor 17 is mounted. The electric motor 17 is supplied via lines 41. The guide element 28, according to FIGS. 2 and 3, is inserted into a recess 13 of the stator 5, the recess being open in the direction of the key channel 11 and also in the direction of the recess 9. The two blocking pins 32, in a locked position according to FIG. 3 in each case, project into a bore 36 of the rotor 10 and thus block the latter. The guide element 28 has a top surface 29 which is curved in accordance with the lateral surface of the rotor 10.

The guide element 28 has mounted in it a latch element 33, which has two protuberances 35 and 42 which, according to FIG. 2, project into the key channel 11 from beneath. As can be seen, the latch element 33 projects through a through-passage 31 of the guide element 28 and projects beyond the surface 29. The protuberance 42, which is closer to a front side 7 of the rotary lock cylinder 1 than the other protuberance 35, has a surface 34 which is inclined in relation to the movement direction of the latch element 33 and also in relation to the movement direction of the blocking element 25. The latch element 33 has, on its underside, a spring element 43, which is supported in a recess 26 of a plate 23. If the latch element 33 is moved downward in the direction of the arrow 44 according to FIG. 2, then the spring element 43 is biased. The spring element 43 here is a helical spring, but it may also be in the form of any other suitable energy-storage element.

The latch element 33 can be moved downward in the direction of the arrow 44 by virtue of the shank 4 being introduced into the key channel 11. As has been mentioned, the spring element 43 is biased here. When the shank 4 is introduced into the key channel 11, the front end of the shank 4 moves onto the inclined surface 34 of the latch element 33 and moves the latter, as has been mentioned, downward. When the shank 4 has been introduced to the full extent, the two protuberances 35 and 42 are located entirely outside the rotor 10 and thus outside the key channel 11. The latch element 33 is preferably arranged in the rear region of the key channel 11, and is thus actuated only when the key 2 has already been largely pushed into the key channel 11.

The latch element 33, according to FIG. 1, has two laterally projecting arms 45 which are arranged beneath the guide element 28 and each engage around a blocking pin 32. Supported on the arms 45 is a respective spring element 37, which projects downward into a through-passage 24. At the bottom end, the springs 37 are supported in each case, according to FIG. 3, on a mushroom-shaped head 38 of the corresponding blocking pin 32. If the latch element 33 is moved downward in the direction of the arrow 44, then the two spring elements 37 are compressed and the two pins 32 are thus biased. Pressing the latch element 33 thus biases the spring element 43 and the two spring elements 37.

The latch element 33, according to FIG. 8, has a strip-like contact element 51 with a top contact surface 52 and a bottom contact surface 53. The top contact surface 52 extends approximately horizontally and is located at the top end of the latch element 33. The bottom contact surface 53 extends downward and is arranged such that, when the latch element 33 is pressed down, it can come into electronic contact with the control arrangement 48. The control arrangement 48 comprises a shroud-like conductor board (shown merely schematically here) which covers the motor 17 and is utilized both on the inside and the outside. Projecting through an opening 54 is an antenna 49 which, as can be seen, is inclined in relation to the horizontal and is directed toward the window 55, which is shown in FIG. 2. The window 55, however, is not imperative.

A top contact tongue 50 and a bottom contact tongue 56 are arranged on the control arrangement 48 according to FIG. 9. When the latch element 33 is pressed down by the key 2, the latch element 33 presses the top contact tongue 50 onto the bottom contact tongue 56. It is also the case that the abovementioned inclination of the antenna 49 is not imperative.

The contact between the top contact tongue 50 and the bottom contact tongue 56 awakens the electronics unit from a "sleep mode", whereupon the motor 17 is actuated. The control means then goes back immediately into the "sleep mode". It is awakened again as soon as the contact between the two contact tongues 50 and 56 is eliminated again, whereupon the motor 17 is actuated again. The control means then goes back into the "sleep mode" again.

The contact element 51 can come into electrical contact with a programming key (not shown here) on the contact surface 52. It is thus possible to use the latch element 33 for further mechatronic functions. The programming key can thus be used to program the electronics unit, for example, in respect of authorization. In order for the battery not to be subjected to undue loading here, the electronics unit can be supplied via the programming key. The contact element 51, however, can also be used as a supply contact for emergency opening when the battery has discharged.

The contact element 51 can thus be used to produce electrical connection between the programming key and the electronics unit of the control arrangement 48. The waking contact via the two contact tongues 50 and 56 is independent of the connection of the contact element and can also take place, in principle, without any electrically conductive component.

In the locked position mentioned, the two blocking pins 32, according to FIG. 3, each butt against a slide 20 by way of the abovementioned head 38. The slide 20 is guided in a slot-like recess 21 of the carrier 15. The slide 20, according to FIG. 3, has an inclined surface 46. The two heads 38 rest on this surface 46. The surface 46 is inclined in relation to the longitudinal direction of the two pins 32 such that the slide 20 can be drawn away from the pins 32 without any significant friction. In that position of the slide 20 which is shown in FIG. 3, the two blocking pins 32 cannot be moved downward. The pins 32 are thus fixed by the slide 20. In order that the two pins 32 can be moved downward by the latch element 33, the slide 20 is displaced to the left by the motor 17 in FIG. 3, engagement of the two blocking pins 32 on the surface 46 thus being eliminated. A comparatively small displacement distance is necessary for this purpose. In order to displace the slide 20, the motor 17 is connected to the plate 23 via a gear mechanism G (FIG. 1). The gear mechanism G has a spindle 18 which has an external thread 19 and engages in a corresponding threaded bore 22 of the slide 20. The gear mechanism G, however, may also be some other suitable gear mechanism, for example a worm gear mechanism or the like. It is also possible, however, for the slide 20 to be actuated in some other way, for example pneumatically, electromagnetically, hydraulically or also using a piezo element. The movement, in the example shown, is a linear movement, although some other movement, for example a rotary movement, is also possible in principle. The energy consumption for displacing the slide 20 is very low. In one direction of rotation, the slide 39 in FIG. 3 is thus moved to the left. A displacement distance in the region of approximately 1 mm is sufficient in order to eliminate the fixing of the two blocking pins 32. In order to move the slide 39 back into the position which is shown in FIG. 3, the spindle 18 is correspondingly rotated in the other direction, in which case the slide 39 moves into the position which is shown in FIG. 3. The gear mechanism G is preferably self-locking, in which case the slide 39 cannot be displaced without the motor 17 being actuated.

The operation of the rotary lock cylinder 1 according to the invention will be explained in more detail hereinbelow with reference to FIGS. 5*a* to 5*d*, 6*a* to 6*d* and 7*a* to 7*d*.

In order to actuate a lock or the like, the shank of the key 2 is introduced into the key channel 11 according to FIGS. 5*a*, 6*a* and 7*a*. The front end of the key shank 4 here moves onto the latch element 33 and moves the latter downward. The two contact elements 50 and 51 come into contact, as a result of which the electronics unit is awakened. When the key 2 is introduced, in addition, the code stored in the key 2 is read and the authorization is checked. If the key shank 4 has been introduced all the way into the key channel 11, the tumblers are appropriately positioned and the latch element 33 is in the bottom position according to FIGS. 5*b*, 6*b* and 7*b*. The somewhat longer protuberance 35 butts, under stressing, against a bottom narrow side 47 of the shank 4. The two blocking pins 32 are still in engagement with the rotor 10, as is shown in FIG. 3. The spring elements 37 and 43 are biased. The slide 20 is located in the position which is shown in FIG. 3, and the two blocking pins 25 are thus fixed in the downward direction. The rotor 10 is thus still blocked. Approximately at the same time as the latch element 33 is pressed down, the code which is stored in the grip 3 of the key 2 is checked in a contactless manner for access authorization in a control means (not shown here). If access authorization is given, and it is decided that the rotor 10 can be actuated by the key 2 which has been introduced, then the actuator or the motor 17 is switched on and the slide 20 is displaced, in which case the two blocking pins 32 are released. The two heads 32 here slide along the inclined surface 46 and are immediately moved downward on account of the biasing of the two spring elements 37 and 43, in which case the engagement of these blocking pins 32 on the rotor 10 is eliminated. On account of the inclination of the surface 46, the blocking pins 25 act on slide 20 by way of a horizontal force component, which assists the movement of the slide 20 and correspondingly reduces the energy consumption. The rotor 10 is then free and can be rotated. FIGS. 5*c*, 6*c* and 7*c* show the state in which the slide 20 has been drawn back and the two blocking pins 32 are located in the bottom position.

If the key 2 is withdrawn from the rotary lock cylinder 1, then the latch element 33 moves upward again, by the action of the bias spring 43, into the position which is shown in FIGS. 5*d*,6*d* and 7*d*. The two protuberances 35 and 42 thus project into the key channel 11 again. The two arms 45, according to FIG. 1, butt against the underside of the guide element 28, as a result of which the movement of the latch element 33 in the upward direction is restricted. By virtue of the bias springs 37, approximately at the same time as the latch element 33, the two blocking pins 32 are moved upward into the position which is shown in FIG. 1. The contact between the two contact elements 50 and 51 is eliminated and the electronics unit is thus awakened again and the motor 17 is activated. The slide 20 is then moved back by the motor 17 into the position which is shown in FIG. 3, and in which the two blocking pins 32 are arrested. The rotor 10 is thus blocked, once again, by the two blocking pins 32. As withdrawal of the key 2 continues, the rest of the spring-loaded tumblers are then also moved into the blocking position. The electronics unit is in "sleep mode" again and the rotary lock cylinder 1 is ready for further actuation.

During the operation explained above, the slide 10 is drawn back only when the latch element 33 is in the bottom position and the spring elements 37 and 43 have thus been biased. This is an obvious result of the delay of the electronics unit by virtue of the code being read in and checked and of the motor 17 being actuated. It is possible, in principle, to minimize this delay such that the slide 20 is drawn back just prior to the actuation of the latch element 33 or the slide 20 is drawn back essentially simultaneously.

FIGS. 10 to 18 show a rotary lock cylinder 1' with an alternative configuration of an actuating arrangement 60. The actuating arrangement 60 operates essentially in the same way as the actuating arrangement 14. Instead of the slide 20, a blocking lever 68 is provided in this case. Two blocking pins 64 engage, in an operating position, in the rotor 10 and are locked in this position by the blocking lever 68. If the authorized key 2 is introduced into the rotary lock cylinder 1', then a motor 78 is switched on and the blocking lever 68 is released by the motor. The biased blocking pin 64 can then be moved, by virtue of the key 2 being introduced to the full extent, into a position in which the rotor 10 is no longer blocked. The essential factor in this configuration is also the fact that the blocking pins 64 are moved into the unblocked position by virtue of the key 2 being pushed into the rotary lock cylinder 1'. The motor 78 merely has the task of releasing the blocking lever 68 and, finally, blocking it again. This is possible with only very low outlay in terms of energy, in which case the energy of the energy source, for example a battery, can be conserved. In addition, jamming can be avoided. The actuating arrangement 60 will be described in more detail hereinbelow.

The actuating arrangement 60 has a housing 76, which is fixed in the rotor 10. A top housing part 61 is positioned on the housing 76 and is fastened on the housing 76 by means of a fastening screw 62 and 79. The motor 78 and the blocking lever 68 are mounted in the housing 76. The top housing part 61 serves for bearing the two blocking pins 64 and the latch element 63.

Connected to the rotor of the motor 78 is a worm 77 which can be rotated by the motor 78, about the motor axis, in the positive and negative directions of rotation. The worm 77 is in engagement with a toothing formation 80 of a toothed segment 71. By virtue of the worm 77 being rotated, the toothed segment 71 can be pivoted about two bearing pins 69 between two positions.

The toothed segment 71, laterally, has an integrally formed bearing pin 72 by means of which it is mounted in a pivotable manner in the housing 76. Arranged opposite this bearing pin 72 is a blocking part 73, which interacts with a ratchet lever 74. The ratchet lever 74 is mounted on the blocking lever 68 such that it can be pivoted about a pivot pin 81. As FIGS. 13 and 14 show, a leaf spring 75 retains the ratchet lever 74 in the position which is shown in FIG. 13. The leaf spring 75 biases the ratchet lever 74, in the counterclockwise direction in FIG. 13, against a crosspiece 83 by way of a lever arm 85. The ratchet lever 74, as can be seen, is angular and, on an upwardly projecting lever arm 86, has a surface 84 against which the abovementioned blocking part 73 butts. In the position which is shown in FIG. 12, the ratchet lever 74 cannot be moved upward since it rests against the locking part 73. In FIG. 12, the blocking lever 68 thus cannot be pivoted counterclockwise about the two bearing pins 69. As a result, the two blocking pins 64 cannot be moved downward out of the position which is shown in FIG. 12.

The two blocking pins 64 have, at a bottom end, a foot 66 which engages in a recess 70 of the blocking lever 68, as is shown, for example, in FIG. 12. The recesses 70 are located in each case directly beneath one of the two bearing pins 69. In the blocking position of the rotary lock cylinder 11, as has been explained above, the blocking levers 68 cannot be pivoted about the two bearing pins 69. The two blocking pins 64 are thus fixed in the blocking position. By virtue of the worm 77 being rotated, the toothed segment 71 can then be pivoted about the bearing pin 72 such that the blocking part 73 no longer blocks the ratchet lever 74 and the blocking lever 68 can be pivoted in the counterclockwise direction in FIG. 12 about the two bearing pins 69. The two blocking pins 64 are thus no longer fixed in the downward direction.

Positioned on each blocking pin 64 is a compression spring 65, which can be subjected to loading by the latch element 63. For this purpose, the latch element 63, according to FIG. 10, has two arms 87, which each accommodate a blocking pin 64. If the latch element 63 is moved downward by the key 2, then the two compression springs 65 are biased. Correspondingly, the two blocking pins 64 are biased in the downward direction against the blocking lever 68. At the same time, the compression spring 67, which is supported on the housing 76, is biased.

The operation of the arrangement according to the invention will be explained in more detail hereinbelow in particular with reference to FIGS. 15 to 18.

Figures 15A, 15B, 15C, 16A, 16B, 16C, 17A, 17B, 17C, 18A, 18B, 18C:
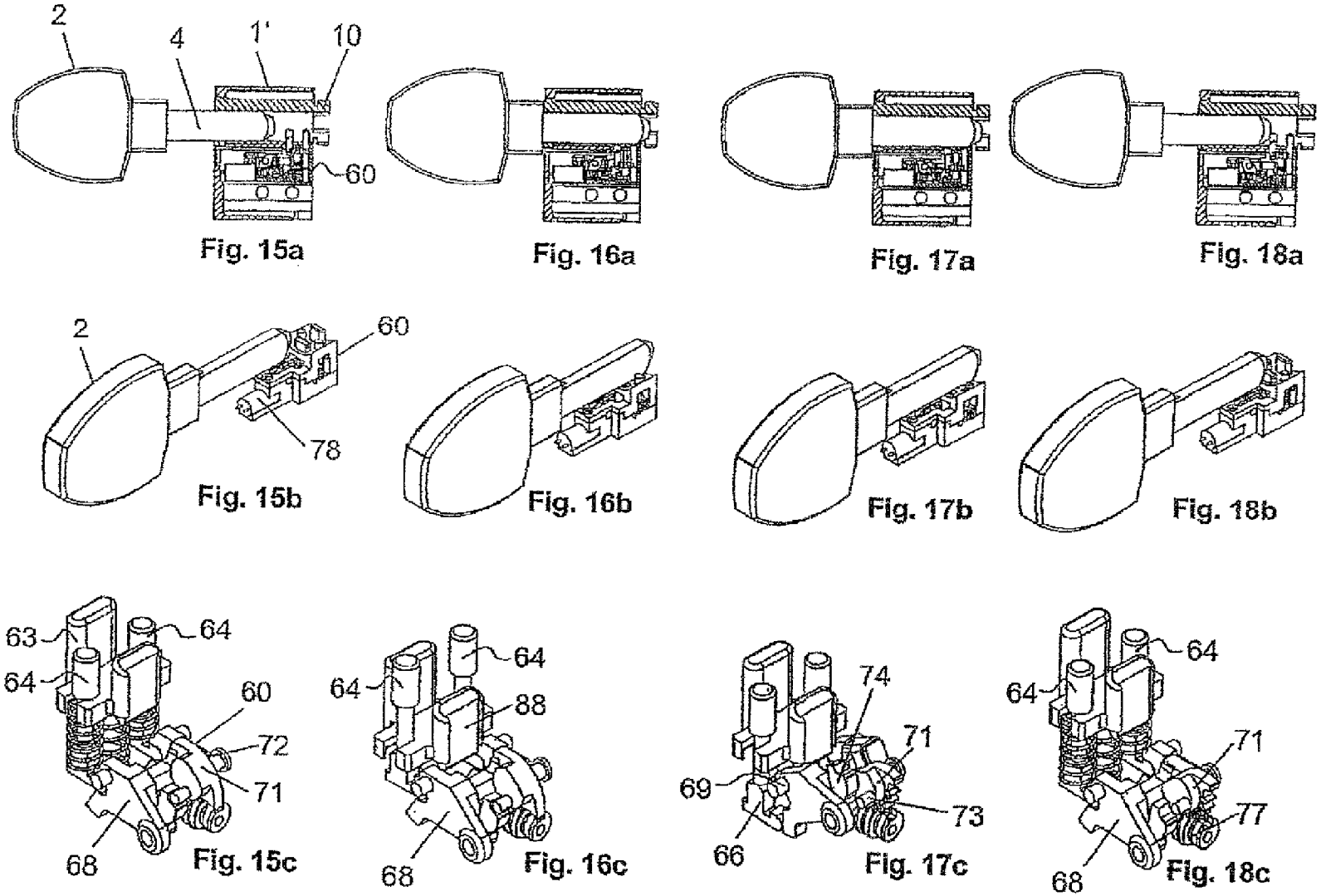

FIGS. 15*a*, 15*b* and 15*c* show the rotary lock cylinder 1' in the blocked position. The two blocking pins 64 each engage in a recess of the rotor 10 by way of a top end and block the rotor. The conventional tumblers, which likewise block the rotor 10, are not shown here. These tumblers are of conventional design and can be positioned appropriately by control bores (not shown here) in the shank 4 of the key 2. In order to release the rotor 10, according to FIGS. 15*a* and 15*b*, the shank 4 of the key 2 is pushed into the key channel. If the front end of the shank 4 then reaches a front part 88 projecting upward into the key channel (FIG. 16*c*), and is pushed in further, then the latch element 63 is moved downward and the springs 65 and 67 are biased. The blocking pins 64, however, still remain in the blocking position. Approximately at the same time, the control means contactlessly checks the code of the key 2. If the key 2 has been authorized, then the motor 78 is switched on and, by virtue of the worm 77 being rotated, the toothed segment 71 is pivoted about the bearing pin 72 into the position which is shown in FIG. 17*c*. As can be seen, the blocking part 73 is then located outside the region of the surface 84 of the ratchet lever 74. The key 2 can then be pushed into the key channel to the full extent and, correspondingly, the two blocking pins 64 and the latch element 63 can be moved further downward. The blocking lever 68 here is pivoted into the position which is shown in FIG. 17*c*. The two feet 66 then rest on the housing 76. The leaf spring 75 is biased by this pivoting movement of the blocking lever 68. Since the blocking pins 64 then no longer engage in the rotor 10, the latter can be rotated, since it is also the case that the rest of the tumblers (not shown) are appropriately positioned. Since the rotor 10 has been released, the lock can be opened.

If the key 2 is withdrawn again according to FIGS. 18*a*, 18*b* and 18*c*, then the latch element 63 is moved upward again into the original position by the spring 67. The leaf spring 75, at the same time, pivots the blocking lever 68 back into the starting position, which is shown in FIGS. 12 and 15*c*. The two blocking pins 64 are likewise raised into the blocking position by the movement of the latch element 63. When the key 2 is withdrawn, the motor 78 is likewise switched in a contactless manner and the worm 77 is rotated in the counterclockwise direction, in which case the toothed segment 71 is pivoted and the blocking part 73 is moved into the blocking position. This results, once again, in the position which is shown in FIG. 15*c*, and in which the rotary lock cylinder 1' is blocked.

LIST OF DESIGNATIONS

1 Rotary lock cylinder
2 Key

3 Key grip
4 Key shank
5 Stator
6 Cylinder bore
7 Front side
8 Cylinder pocket
9 Recess
10 Rotor
11 Key channel
12 Recess
13 Recess
14 Actuating arrangement
15 Carrier
16 Recess
17 Motor
18 Spindle
19 Thread
20 Slide
21 Recess
22 Threaded bore
23 Plate
24 Through-passage
25 Blocking element
26 Through-passage
27 Control arrangement
28 Guide element
29 Surface
30 Through-passage
31 Through-passage
32 Blocking pin
33 Latch element
34 Surface
35 Protuberance
36 Bore
37 Spring elements
38 Head
39 Surface
40 Bore
41 Lines
42 Protuberance
43 Spring element
44 Arrow
45 Arms
46 Surface
47 Narrow side
48 Control arrangement
49 Antenna
50 Top contact tongue
51 Contact element
52 Contact surface
53 Contact surface
54 Opening
55 Window
56 Bottom contact tongue
60 Actuating arrangement
61 Housing part
62 Fastening screw
63 Latch element
64 Blocking pin
65 Compression spring
66 Foot
67 Compression spring
68 Blocking lever
69 Bearing pin
70 Recess
71 Toothed segment
72 Bearing pin
73 Blocking part
74 Ratchet lever
75 Leaf spring
76 Housing
77 Worm
78 Motor
79 Fastening screw
80 Toothing formation
81 Pivot pin
82 Arm
83 Crosspiece
84 Surface
85 Lever arm
86 Lever arm
87 Arm
88 Part
G Gear mechanism

The invention claimed is:

1. An electromechanical rotary lock cylinder having a stator and a rotor mounted therein, having a blocking element which is mounted in a bottom part of the stator and, in a locked position, engages in the rotor and, in an open position, releases the rotor, and having an actuator which can be controlled depending on information provided on a key and which, in a blocking position, fixes the blocking element and, in another position, releases the blocking element, wherein a latch element which directly engages in a key channel of the rotor and can be moved by the key, is provided to displace the blocking element from the locked position into the open position.

2. The rotary lock cylinder as claimed in claim 1, wherein the latch element projects into the key channel in a rear region of the rotor and can be actuated by the front end of the key introduced into the key channel.

3. The rotary lock cylinder as claimed in claim 2, wherein a movable part, which can be moved between two positions by the actuator, is provided in order to fix the blocking element in the blocking position, the blocking element being fixed in a first position and being released in a second position.

4. The rotary lock cylinder as claimed in claim 2, wherein the movable part is a slide or a pivotable lever, on which the blocking element is fixed in the blocked position.

5. The rotary lock cylinder as claimed in claim 2, wherein the movable part can be displaced linearly by the actuator.

6. The rotary lock cylinder as claimed in claim 1, wherein the latch element can be moved counter to the reactive force of a spring.

7. The rotary lock cylinder as claimed in claim 1, wherein the blocking element has at least one blocking pin, which can be biased by a spring element responsive to the latch element being actuated.

8. The rotary lock cylinder as claimed in claim 7, wherein at least two blocking pins are provided, and in that these can each be biased by a spring element.

9. The rotary lock cylinder as claimed in claim 4, wherein the pivotable lever has at least one recess, in which one end of the blocking element engages.

10. The rotary lock cylinder as claimed in claim 1, further comprising a toothed segment has a blocking part and can be moved by the actuator between a blocking position and a releasing position.

11. The rotary lock cylinder as claimed in claim 9, wherein the blocking part interacts with a lever which is arranged on the pivotable lever.

12. The rotary lock cylinder as claimed in claim 11, wherein the lever, which interacts with the blocking part, is a ratchet lever.

13. The rotary lock cylinder as claimed in claim 11, wherein the lever, which interacts with the blocking part, has a top surface against which the blocking part butts in the blocking position.

14. An electromechanical rotary lock cylinder having a stator and a rotor mounted therein, having a blocking element which is mounted in a bottom part of the stator and, in a locked position, engages in the rotor and, in an open position, releases the rotor, and having an actuator which can be controlled depending on information provided on a key and which, in a blocking position, fixes the blocking element and, in another position, releases the blocking element, wherein a latch element which engages in a key channel of the rotor and can be moved by the key, is provided to displace the blocking element from the locked position into the open position, and further comprising a toothed segment has a blocking part and can be moved by the actuator between a blocking position and a releasing position.

15. An electromechanical rotary lock cylinder having a stator and a rotor mounted therein, having a blocking element which is mounted in a bottom part of the stator and, in a locked position, engages in the rotor and, in an open position, releases the rotor, and having an actuator which can be controlled depending on information provided on a key and which, in a blocking position, fixes the blocking element and, in another position, releases the blocking element, wherein a latch element which engages in a key channel of the rotor and can be moved by the key, is provided to displace the blocking element from the locked position into the open position, wherein the movable part is a slide or a pivotable lever, on which the blocking element is fixed in the blocked position, wherein the pivotable lever has at least one recess, in which one end of the blocking element engages, and wherein the blocking part interacts with a lever which is arranged on the pivotable lever.

* * * * *